US008459985B2

(12) United States Patent
Carroni et al.

(10) Patent No.: US 8,459,985 B2
(45) Date of Patent: Jun. 11, 2013

(54) METHOD AND BURNER ARRANGEMENT FOR THE PRODUCTION OF HOT GAS, AND USE OF SAID METHOD

(75) Inventors: Richard Carroni, Niederrohrdorf (CH); Bettina Paikert, Oberrohrdorf (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 12/876,508

(22) Filed: Sep. 7, 2010

(65) Prior Publication Data

US 2011/0059408 A1 Mar. 10, 2011

Related U.S. Application Data

(63) Continuation of application No. PCT/EP2009/051764, filed on Feb. 16, 2009.

(30) Foreign Application Priority Data

Mar. 7, 2008 (CH) ..... 00350/08

(51) Int. Cl.
*F23D 14/62* (2006.01)

(52) U.S. Cl.
USPC ..... 431/9; 431/8; 431/12; 431/354

(58) Field of Classification Search
USPC .. 431/9, 8, 4, 12, 351, 352, 354, 350; 60/737, 60/738
See application file for complete search history.

(56) References Cited

U.S. PATENT DOCUMENTS

| | | | |
|---|---|---|---|
| 3,859,786 | A | 1/1975 | Azelborn et al. |
| 4,292,801 | A | 10/1981 | Wilkes et al. |
| 4,932,861 | A | 6/1990 | Keller et al. |
| 5,454,220 | A | 10/1995 | Althaus et al. |
| 5,588,826 | A | 12/1996 | Doebbeling et al. |
| 5,592,819 | A | 1/1997 | Ansart et al. |
| 5,609,030 | A | 3/1997 | Althaus |
| 5,626,017 | A | 5/1997 | Sattelmayer |
| 5,673,551 | A | 10/1997 | Doebbeling |
| 5,778,676 | A | 7/1998 | Joshi et al. |
| 5,791,894 | A | 8/1998 | Doebbeling et al. |
| 5,832,732 | A | 11/1998 | Knopfel et al. |

(Continued)

FOREIGN PATENT DOCUMENTS

| | | | |
|---|---|---|---|
| CH | 1838/07 | * | 11/2007 |
| DE | 44 46611 | A1 | 6/1996 |

(Continued)

OTHER PUBLICATIONS

Joos, F. et al., "Field Experience of the Sequential Combustion System for the ABB GT24/GT26 Gas Turbine Family", IGTI/ASME 98-GT-220, 1998 Stockholm.

(Continued)

*Primary Examiner* — Alfred Basichas
(74) *Attorney, Agent, or Firm* — Leydig, Voit & Mayer, Ltd.

(57) ABSTRACT

A method for producing hot gas for operating a turbomachine fired with at least one combustion chamber includes premixing a fuel with a plurality of operating gases by introducing fuel into the plurality of operating gases in a mixing chamber disposed upstream of the combustion chamber using a burner arrangement, wherein the fuel includes at least one of a combustible gas and a $H_2$-rich fuel; and introducing the premixed fuel into the combustion chamber.

11 Claims, 4 Drawing Sheets

U.S. PATENT DOCUMENTS

| | | | | |
|---|---|---|---|---|
| 5,921,770 | A | 7/1999 | Sattelmayer | |
| 5,987,889 | A | 11/1999 | Graves et al. | |
| 6,019,596 | A | 2/2000 | Knopfel et al. | |
| 6,045,351 | A | 4/2000 | Doebbling et al. | |
| 6,059,565 | A | 5/2000 | Knoepfel et al. | |
| 6,126,439 | A | 10/2000 | Knoepfel et al. | |
| 6,152,726 | A | 11/2000 | Ruck et al. | |
| 7,162,864 | B1 | 1/2007 | Schefer et al. | |
| 7,491,056 | B2 | 2/2009 | Knoepfel | |
| 7,871,262 | B2 | 1/2011 | Carroni et al. | |
| 8,033,821 | B2 * | 10/2011 | Eroglu | 431/9 |
| 2001/0034001 | A1 * | 10/2001 | Poe et al. | 431/116 |
| 2002/0064738 | A1 * | 5/2002 | Hugens, Jr. | 431/2 |
| 2004/0172949 | A1 | 9/2004 | Stuttford | |
| 2004/0226299 | A1 | 11/2004 | Drnevich | |
| 2007/0259296 | A1 | 11/2007 | Knoepfel | |
| 2008/0000234 | A1 | 1/2008 | Commaret et al. | |
| 2009/0044539 | A1 | 2/2009 | Eroglu et al. | |

FOREIGN PATENT DOCUMENTS

| | | | |
|---|---|---|---|
| DE | 196 54 116 | A1 | 6/1998 |
| EP | 0 321 809 | A1 | 6/1989 |
| EP | 0 620 362 | A1 | 10/1994 |
| EP | 0 671 590 | A | 9/1995 |
| EP | 0 694 740 | A | 1/1996 |
| EP | 0 704 657 | A1 | 4/1996 |
| EP | 0 777 081 | A1 | 6/1997 |
| EP | 0 833 105 | A | 4/1998 |
| EP | 0 913 630 | A1 | 5/1999 |
| EP | 0 918 190 | A | 5/1999 |
| EP | 0 994 300 | A | 4/2000 |
| EP | 1 873 455 | A | 1/2008 |
| WO | WO 2006/048405 | A1 | 5/2006 |
| WO | WO 2006/058843 | A | 6/2006 |
| WO | WO 2006/069861 | A1 | 7/2006 |
| WO | WO 2007/113074 | A1 | 10/2007 |

OTHER PUBLICATIONS

Mukherjee, "State-of-the-art gas turbines—a brief update" ABB Review Feb. 1997 (pp. 4-14) Switzerland.

International Search Report from corresponding PCT Application No. PCT/EP2009/051764 dated Jul. 14, 2009.

International Search Report from corresponding PCT Application No. PCT/EP2009/051695 dated Jul. 14, 2009.

* cited by examiner

METHOD AND BURNER ARRANGEMENT FOR THE PRODUCTION OF HOT GAS, AND USE OF SAID METHOD

CROSS REFERENCE TO PRIOR APPLICATIONS

This application is a continuation of International Patent Application No. PCT/EP2009/051764, filed Feb. 16, 2009, which claims priority to Swiss Patent Application No. CH 00350/08, filed Mar. 7, 2008. The entire disclosure of both applications is incorporated by reference herein.

FIELD

The present invention relates to the field of combustion technology. It refers to a method for combusting $H_2$-rich fuels. It also refers to a burner arrangement for implementing the method and for its use.

BACKGROUND

From WO-A1-2006/069861, a premix burner with subsequent mixing section or mixer tube (a so-called AEV burner) has been known, in which in the premix burner, which is formed according to EP-A1-704 657, a first fuel can be centrally injected and between the air inlet slots or passages which are formed by the shells in the swirler (shown clearly especially in EP-A1321 809) at least one second fuel can be introduced into the air which flows into the inner space there. In the subsequent mixer tube, provision is made for a further device for injecting a third fuel. All printed publications which are referred to here or later, and their further developments, form an integrating element of this application.

For combusting $H_2$-rich fuels, as created for example in the form of syngas during coal gasification, it has already been proposed to inject at least some of the $H_2$-rich fuel via the mixer tube of such a premix burner. Also, such a premix burner has already been tested with natural gas in lean premix operation, during which under high pressure $H_2$-rich fuels with $H_2$-to-$N_2$ ratios of 70/30 and 60/40 have been injected in an axially staged manner in the premix burner and in the mixer tube.

During these tests, it has been shown that if a changeover is made from natural gas entirely to the $H_2$-rich fuel, the flame migrates upstream into the mixer tube. Although the burner was able to be operated in this way without damage and with sufficiently low NOx emission, numerous disadvantages arose, however, specifically:

- The pressure losses in the premix burner are increased by the factor of 3. This is undesirable in the case of gas turbines with regard to an associated gas turbine cycle.
- The available mixing length, i.e. the distance between the location of the injection of the fuel and the flame front, is reduced, which leads to increased NOx-emission.
- High-frequency pulsations gain in importance. In this context, it may be mentioned that the thermoacoustic vibrations represent a hazard for each type of combustion application. They lead to high-amplitude pressure vibrations, to limitation of the operating range, and they can increase pollutant emissions. This applies especially to combustion systems with low acoustic damping, as is the case for example in annular combustion chambers with reverberant walls. In order to ensure a high performance conversion over a wide operating range with regard to pulsations and pollutant emissions, provisions against these pulsations must be made.

SUMMARY OF THE INVENTION

In an aspect of the invention, a method for combusting $H_2$-rich fuels is provided which reliably prevents migrating of the flame back into the burner and also pulsations, even during a changeover from natural gas to $H_2$-rich fuels.

In an embodiment of the invention, in addition to the $H_2$-rich fuel, a small amount of natural gas is introduced into the burner arrangement during premix operation and combusted together with the $H_2$-rich fuel.

One development of the method according to the invention is characterized in that first of all an air/fuel mixture is created from the air and the natural gas, and in that the $H_2$-rich fuel is then injected into the air/fuel mixture. In particular, a burner arrangement, which comprises a premix burner and a mixer tube which is connected to it, is used for this purpose, wherein the fuel/air mixture is created in the premix burner. The $H_2$-rich fuel can be injected into the mixer tube and/or into the swirler. A swirler can be advantageously used as the head stage of the premix burner, as is described for example in EP-A1-321 809.

Another development of the method according to the invention is characterized in that first of all the natural gas and the $H_2$-rich fuel are intermixed, and in that the resulting fuel mixture is mixed and combusted with air in the burner arrangement. As a result of this, the system of fuel feed and fuel distribution can especially be simplifed. Also in this case, a burner arrangement can preferably be used which comprises a premix burner and a mixer tube which is connected to it, wherein in the premix burner the air/fuel mixture is created from the air and the fuel mixture.

A burner arrangement can also be used, however, as is disclosed for example in WO-A1-2007/113074, in which within the scope of a sequential combustion a fuel lance projects into a hot gas flow, and wherein the fuel mixture is injected via the fuel lance, if necessary with additional air, into the hot gas flow. The fuel lances which are shown in this printed publication (FIGS. 2-6) are designed for use in the low-pressure combustion chamber (Pos. 14). Also, this last-named printed publication forms an integrating element of this application. The operation of such a low-pressure combustion chamber with the use of a fuel lance which is described above in a sequentially fired gas turbine, results for example from EP 620 362 A1, which printed publication also represents an integrating element of this description.

BRIEF DESCRIPTION OF THE DRAWINGS

The invention shall subsequently be explained in more detail based on exemplary embodiments in conjunction with the drawing. All elements which are not necessary for the direct understanding of the invention have been omitted. Like elements are provided with the same designations in the various figures. The flow direction of the media is indicated by arrows.

In the drawings.

DETAILED DESCRIPTION

Figure 1:
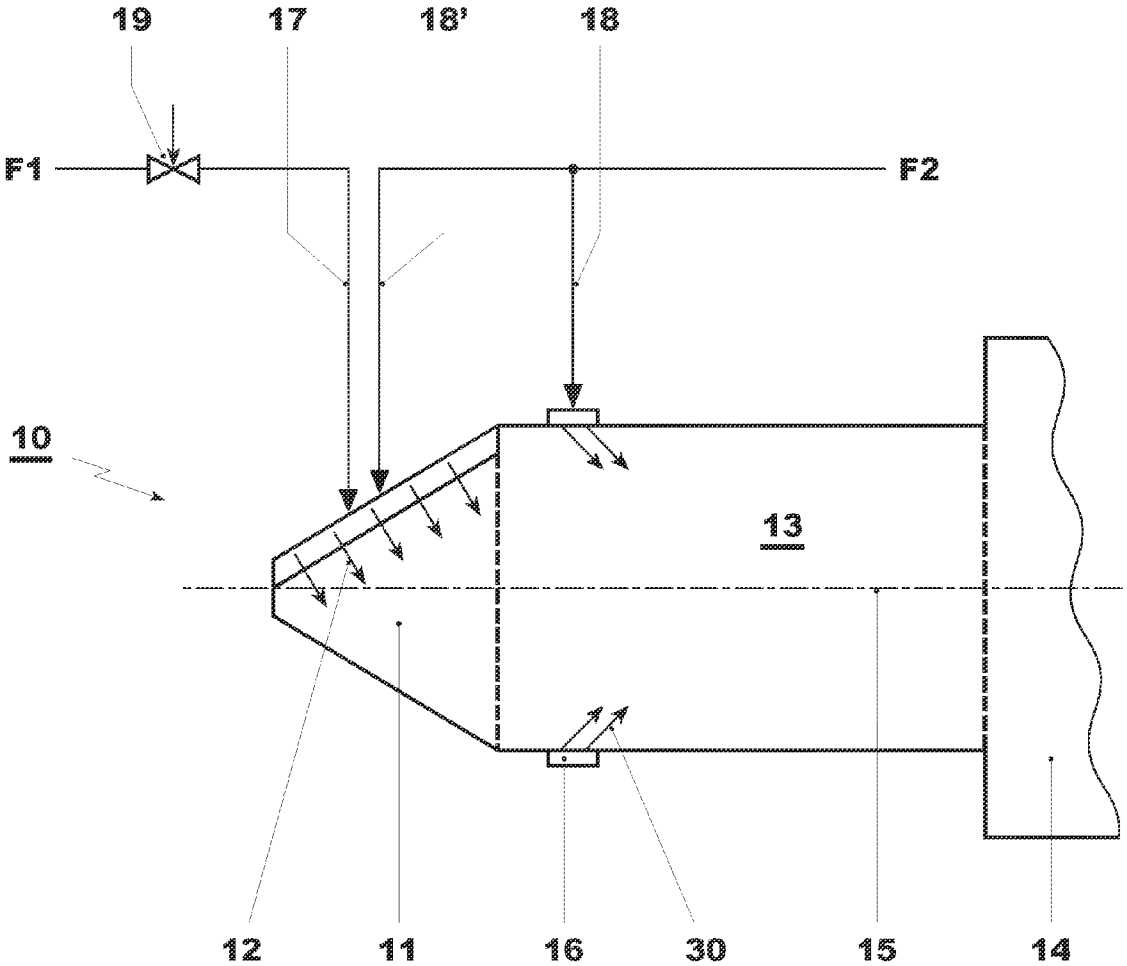
FIG. 1 shows a simplified schematized view of a burner arrangement of the AEV type, in which according to one exemplary embodiment of the method according to the invention the additional natural gas and the $H_2$-rich fuel are injected one after the other in the flow direction, wherein the $H_2$-rich fuel can also be selectively injected into the swirler.

Reproduced in FIG. 1, in a simplified schematized view, is a burner arrangement with a head stage, which is formed as a swirler, and an adjoining mixer tube, in which according to one exemplary embodiment of the method according to the invention the additional natural gas and the $H_2$-rich fuel are injected one after the other in the flow direction. The burner arrangement 10 comprises a swirler 11, which at times can also be used as a stand-alone premix burner, wherein this is formed in a known manner per se in the shape of a cone, as is described for example in EP-A1-321 809. In this case, it is important that the swirl intensity in the swirler is selected via its geometry so that the bursting of the vortex, or vortices, does not take place in the mixer tube but further downstream at the combustion chamber inlet, wherein the length of the mixer tube 13 is to be dimensioned so that a satisfactory mixture quality is established for all fuels which are in use. If such a swirler is taken as a basis, then the swirl intensity results from the design of the corresponding cone angle, of the air inlet slots or passages, and their number. Combustion air flows into the interior of the premix burner 11 through said air inlet slots or passages, wherein in the region of these air inlet slots or passages provision is made for means for injecting a fuel in such a way that an air/fuel mixture 12 is formed in the inner space which is formed by the partial cone shells. The air/fuel mixture 12 is given a swirl around the axis 15 of the burner arrangement 10 and enters a mixer tube 13 downstream, where the complete mixing-through of air and fuel takes place. The mixer tube 13 opens into a combustion chamber 14 in which a flame front is formed, with which the air/fuel mixture is combusted. On the mixer tube 13, provision is made for an injection device 16 of preferably annular design, through which fuel can be additionally injected into the mixer tube 13 and incorporated into the combustion. When required, transfer passages, which are not shown in more detail in this figure, are provided in a transition region between swirler 11 and mixer tube 13 and undertake the transfer of air or air/fuel flow, which is formed in the swirler 11, into the mixer tube 13. Such a configuration results from EP-A1-704 657, wherein its disclosure content forms an integrating element of this application. Furthermore, the swirler can be designed so that this comprises at least two hollow partial shells which are nested one inside the other in the flow direction, making up a body, the cross section of which in the flow direction, in contrast to the swirler 11 above, does not extend conically but cylindrically or virtually cylindrically, wherein in the inner space, preferably on the symmetry axis of the body, an inner body is provided, the cross section of which in the flow direction reduces conically or virtually conically. Such a configuration has been known for example from EP-A1-777 081, wherein this printed publication also forms an integrating element of this application.

According to the exemplary embodiment which is shown in FIG. 1, a small quantity of natural gas F1 is injected into the premix burner 11 during premix operation and mixed with air. The natural gas F1 is fed via a first fuel feed line 17 and can be adjusted to the required mass flow for example by means of a valve 19. The main part of the output of the burner arrangement 10 is contested, however, by an $H_2$-rich fuel F2 which is directed to the injection device 16 via a second fuel feed line 18 and injected there into the air/fuel mixture 12 from the swirler 11 acting upstream. A portion of this $H_2$-rich fuel 18' can also be selectively injected into the swirler 11, as results from FIG. 1, wherein its portion typically constitutes up to 30%. This type of burner operation has the following advantages:

- The pressure loss coefficient Zeta is reduced from 2.8 to 1.5, which corresponds to a sharp reduction of the pressure loss in the burner.
- The high-frequency pulsations (of 2 to 4 kHz) are practically eliminated.
- NOx-emissions are minimized, this based on the fact that the flame is maintained by a maximized premixed air/fuel mixture.
- The fuel feed lines 17 in the region of the swirler 11 are constantly purged for the natural gas so that changing over to natural gas operation is possible within an extremely short time.
- If the flame front actually migrates upstream into the burner, it is anchored relatively far downstream in the mixer tube and burns in a stable and reliable manner. If in a multi-burner arrangement, as is customary in gas turbines, a flashback occurs in a burner, this leads more easily to a stable state in the burner and not to an operation-relevant negative development in which the flame front migrates still further upstream until destruction of the burner commences, as is immanently the case in normal burners. If this state occurs, then the reason to be looked for is that the burner in question is blocked and the throughflow of air is reduced. This then also means that an individual burner can be temporarily shut down and reignited. The operation of the other burners in the gas turbine is consequently not affected.
- The reason that the flame front in this case cannot flash back to the premixed burner 11 which is used according to the invention, and destruction cannot correspondingly occur, is to be seen as that of the very same flame front assuming a fixed local anchoring inside the mixer tube 13 in such a way that it also cannot creep upstream either, the air flow hardly being impaired in the process.

Figure 2:
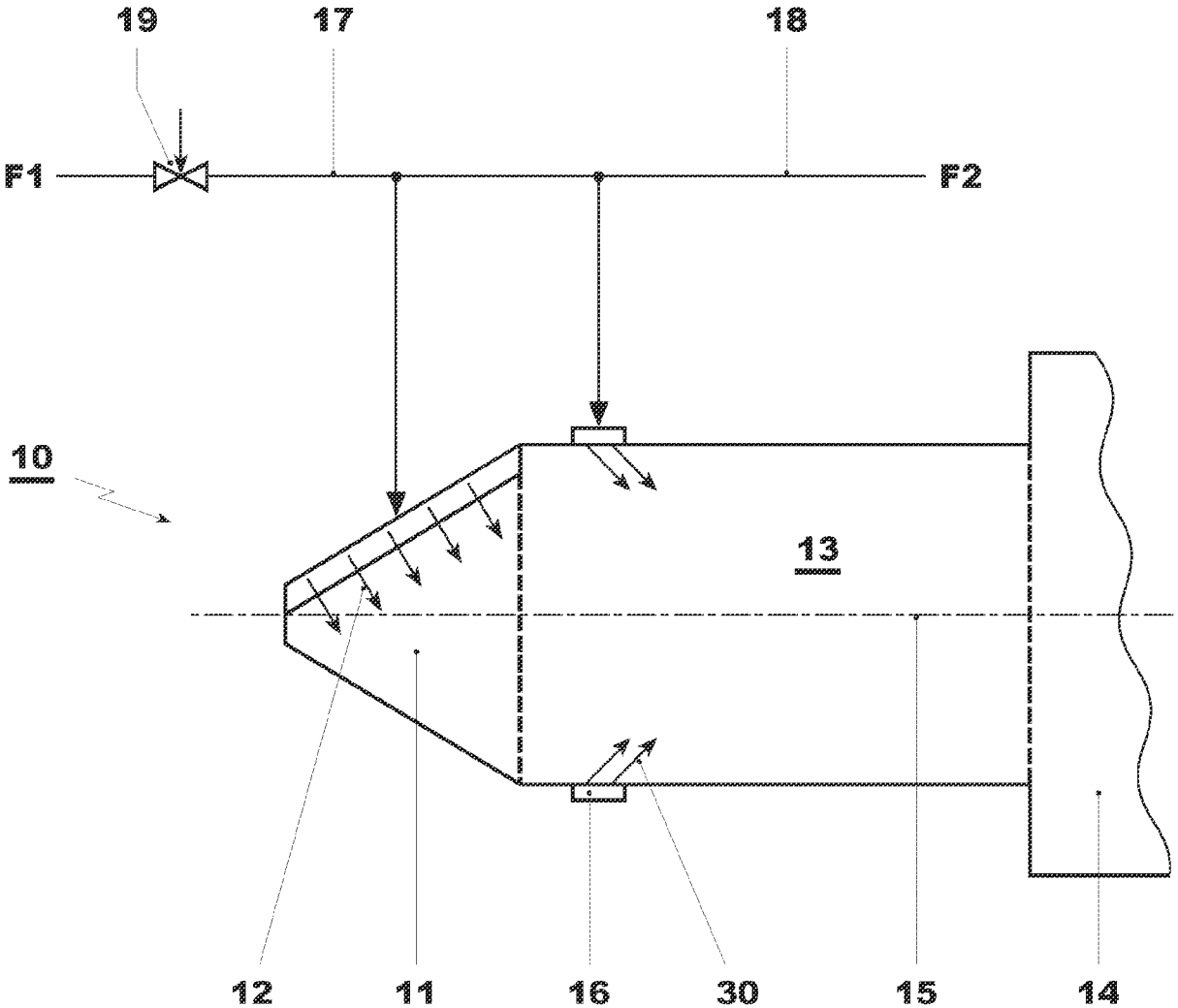
FIG. 2 shows a view which is comparable to FIG. 1 of a burner arrangement of the AEV type, in which according to another exemplary embodiment of the method according to the invention the additional natural gas and the $H_2$-rich fuel are first of all mixed and the resulting mixture is then injected.

Whereas in the exemplary embodiment of FIG. 1 the natural gas F1 and the $H_2$-rich fuel F2 are injected separately and in axial staging in the burner arrangement 10, it is also conceivable to premix the two fuels before injection according to FIG. 2. For this purpose, the two fuel feed lines 17 and 18 for the fuels F1 and F2 are brought together and the resulting fuel mixture is then injected on the one hand into the swirler 11 and on the other hand into the injection device 16 on the mixer tube 13.

Figure 3:
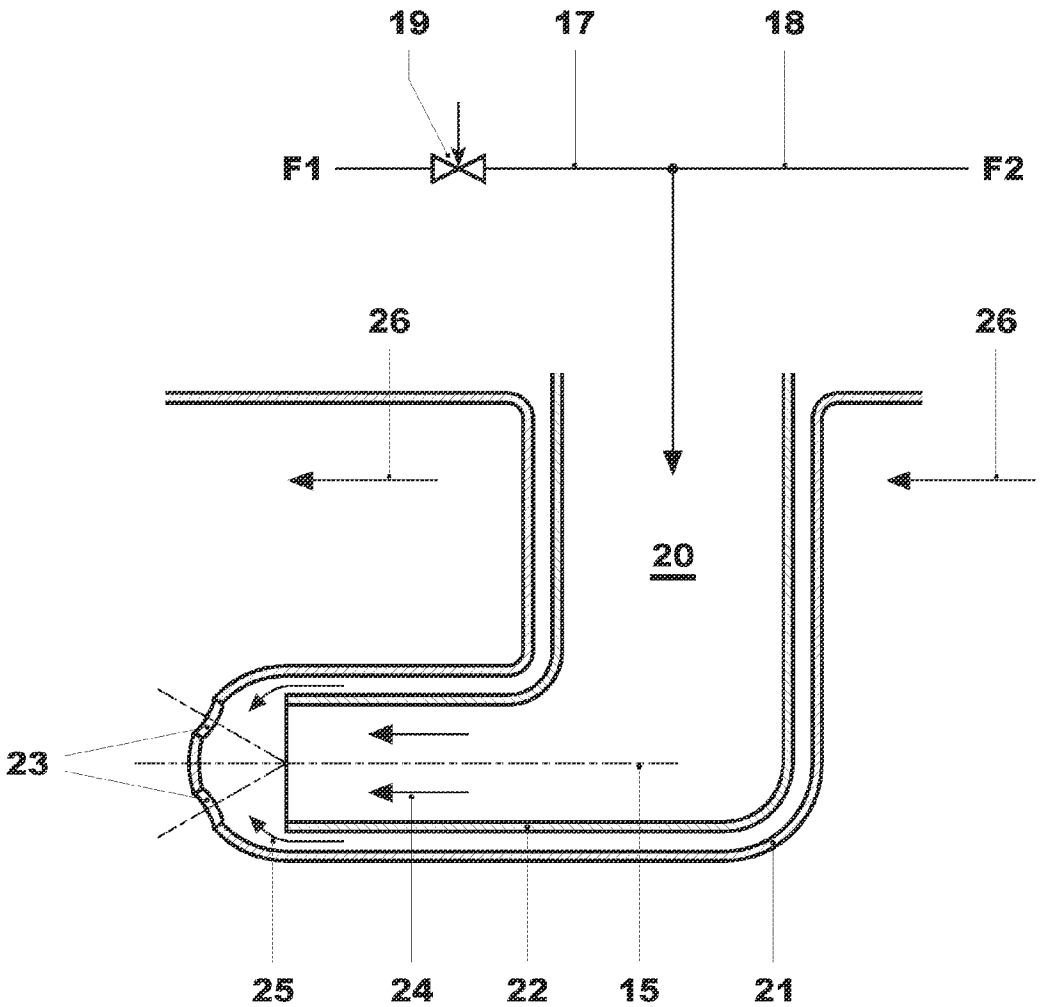
FIG. 3 shows a simplified schematized view of a burner arrangement with a fuel lance, which is provided for sequential combustion, in which according to another exemplary embodiment of the method according to the invention the additional natural gas and the $H_2$-rich fuel are first of all mixed and the resulting mixture is then injected into a hot gas flow.

Stabilizing the flame position and limiting NOx-emissions which is associated therewith, and avoiding pulsations by means of a small addition of natural gas, can also be applied in a gas turbine with sequential combustion, specifically in the second or subsequent combustion stage. In FIG. 3, a fuel lance 20 is reproduced, as is disclosed in WO-A1-2007/113074 which is referred to in the introduction, wherein this printed publication also forms an integrating element of this application. The fuel lance 20 projects into the hot gas flow 26 from a previous combustion stage which can comprise for example the burner arrangement which is shown in FIG. 1. In the fuel lance 20, an outer tube 21 and an inner tube 22 are arranged one inside the other. The outer tube has injection orifices 23. Air 25 is fed into the gap between inner tube 22 and outer tube 21, while through the inner tube 22 a mixture consisting of the $H_2$-rich fuel F2 and the small portion of natural gas F1 is introduced. The air/fuel mixture which is formed discharges into the hot gas flow 26 and ignites there, forming a flame.

Figure 4:
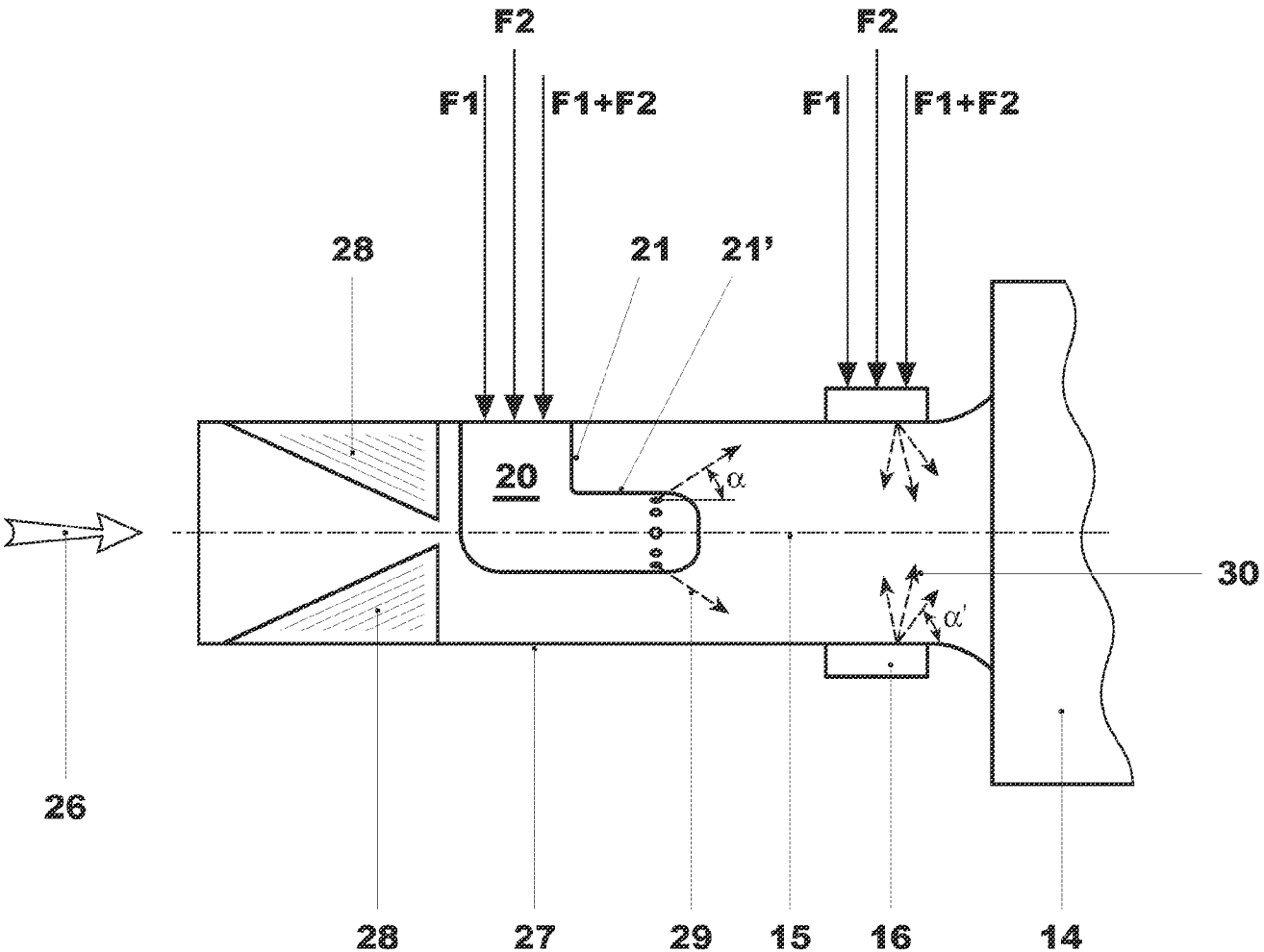
FIG. 4 shows use of the fuel lance according to FIG. 3 in a combustion chamber of a gas turbine with sequential combustion.

FIG. 4 shows in schematic view a low-pressure combustion chamber 27 in a gas turbine which is operated by means of sequential combustion. Such a gas turbine results for example from an article by Joos, F. et al., "Field Experience of the Sequential Combustion System for the ABB GT24/GT26 Gas Turbine Family", IGTI/ASME 98-GT-220, 1998 Stockholm, wherein FIG. 1 shows the construction of such a gas turbine. Furthermore, reference is made to a publication in ABB Review 2/1997 (pages 4-14), especially to FIG. 15 (page 13), in which the main components of such a gas turbine are also shown. The low-pressure combustion chamber is referred to here as a "SEV combustor". The operation of this low-pressure combustion chamber 27 is designed for self-ignition, i.e. the hot gas flow 26 which flows into the combustion chamber 27 has a very high operating temperature in such a way that combustion of the fuels F1 or F1+F2 or F2, which are injected via at least one fuel lance 20, is carried out by means of self-ignition. With this type of combustion, it is important that the flame front in the combustion chamber 14 which is arranged downstream remains stable as regards location. Also, for achieving this aim, provision is made in this self-ignition combustion chamber 27, preferably arranged on the inner or outer wall in the circumferential direction, for a row of elements 28, so-called vortex generators, which are positioned in the axial direction preferably upstream of the fuel lance 20 which basically comprises a vertical outer tube 21 and a horizontal outer tube 21'. The purpose of these elements 28 is to generate vortices which induce a backflow zone. The design of these vortex generators 28 and also the arrangement in the combustion chamber 27 results from DE-44 46 611 A1, wherein this printed publication also forms an integrating element of this description. With regard to the different injection possibilities 29 of the fuels F1 or F1+F2 of F2 into the combustion chamber 27, reference is made essentially to WO 2007/113074 A1. A further possibility is apparent in FIG. 4 itself, in which the symbolized fuel jets 29 flow from one or more injection orifices which are arranged on the circumference of the axial outer tube 21' of the fuel lance 20 and inject the fuel, or fuels, into the flowing 26 of the combustion chamber 27 at a specific injection angle $\alpha$. This injection angle $\alpha$ preferably varies between 20° and 120° in relation to the surface of the horizontal outer tube section 21' of the fuel lance 20, wherein injection angles of less than 20° and more than 120° are also possible, however. A further injection of the fuels F1 or F1+F2 or F2 is provided downstream of the fuel lance 20 via the injection device 16 which also has one or more injection orifices, wherein the direction of the fuel jets 30 can assume a broad spectrum, as results from FIG. 4, the injection preferably having an angle $\alpha'$ of between 20° and 120° in relation to the surface of the inner wall of the combustion chamber 27, wherein injection angles of less than 20° and more than 120° are also possible. The type of operation of this combustion chamber 27 concerning the fuels which are introduced there and with regard to the injection angle of the fuel jets or of the fuel orifices 29, 30, depends upon factors which are related to the sequential combustion. Naturally, the introduction of the fuels according to FIG. 4 can also be provided in the same or similar manner in the case of the previously described combustion chambers according to FIGS. 1 and 2. An additional introduction of a quantity of air, as results from FIG. 3, is likewise possible and also provided, when required, also during operation of the combustion chamber 27 from FIG. 4.

The subject according to the invention can be used with particular advantage in a gas turbine with at least one combustion chamber stage, wherein the hot gas which is produced is expanded in the gas turbine, performing work.

LIST OF DESIGNATIONS

10 Burner arrangement
11 Swirler
12 Air/fuel mixture
13 Mixer tube
14 Combustion chamber
15 Axis
16 Injection device
17, 18 Fuel feed line
19 Valve
20 Fuel lance
21 Vertical outer tube of the fuel lance
21' Horizontal outer tube of the fuel lance
22 Inner tube
23 Injection orifice
24 Fuel
25 Air
26 Hot gas flow
27 Low-pressure combustion chamber operated by means of self-ignition
28 Vortex generators
29 Fuel injection
30 Fuel injection
F1 Fuel (natural gas)
F2 Fuel ($H_2$-rich, for example syngas)
$\alpha$ Injection angle
$\alpha'$ Injection angle

What is claimed is:

1. A method for producing hot gas for operating a turbomachine fired using at least one combustion chamber, the method comprising:

providing a burner arrangement upstream of the combustion chamber, the burner arrangement including a swirler and a mixing tube;

premixing a fuel including natural gas with air in the swirler so as to create an air/fuel mixture;

injecting an $H_2$-rich fuel into the air/fuel mixture so as to produce a premixed fuel by injecting the $H_2$-rich fuel into the mixing tube; and introducing the premixed fuel into the combustion chamber.

2. The method as recited in claim 1, wherein the injecting the $H_2$-rich fuel includes injecting a ratio of the $H_2$-rich fuel of at most 30% to the natural gas.

3. The method as recited in claim 1, wherein the introducing the fuel is performed at an angle.

4. The method as recited in claim 3, wherein the angle is between 20° and 120°.

5. The method as recited in claim 1, wherein the burner arrangement includes a fuel lance projecting into a hot gas flow, and further comprising injecting the fuel mixture into the hot gas flow using the fuel lance.

6. The method as recited in claim 5, wherein the at least one combustion chamber includes a second combustion chamber, and further comprising operating the second combustion chamber using a self-igniting combustion process, wherein the introducing is performed using the at least one fuel lance.

7. The method as recited in claim 6, further comprising operating at least one vortex generator upstream of fuel lance.

8. The method as recited in claim 6, further comprising disposing at least one further injection device downstream of the fuel lance.

9. The method as recited in claim 6, wherein the introducing includes feeding air with the at least one fuel.

10. The method as recited in claim 9, further comprising feeding air into the at least one fuel separately.

11. The method as recited in claim 9, further comprising admixing air with the at least one fuel.

* * * * *